United States Patent [19]

Saiger

[11] Patent Number: 4,911,500

[45] Date of Patent: Mar. 27, 1990

[54] SPRING CHAIR FRAME AND METHOD OF FABRICATING SAME

[75] Inventor: Herbert C. Saiger, Troy, Ohio

[73] Assignee: Crown Leisure Products, Inc., Owosso, Mich.

[21] Appl. No.: 246,424

[22] Filed: Sep. 20, 1988

[51] Int. Cl.[4] ..... A47C 1/02

[52] U.S. Cl. ..... 297/287; 297/447; 297/295

[58] Field of Search ..... 297/286, 287, 296, 297, 297/301, 302, 447, 448

[56] References Cited

U.S. PATENT DOCUMENTS

| | | | |
|---|---|---|---|
| 2,063,781 | 12/1936 | Ball | 297/286 |
| 2,069,456 | 2/1937 | McGowen | 297/287 |
| 2,365,003 | 12/1944 | Reinholz | 297/287 X |
| 2,771,122 | 11/1956 | Straub | 297/287 |
| 4,580,836 | 4/1986 | Verney | 297/296 |

FOREIGN PATENT DOCUMENTS

| | | | |
|---|---|---|---|
| 795191 | 3/1936 | France | 297/287 |
| 324490 | 2/1935 | Italy | 297/295 |

*Primary Examiner*—Peter R. Brown

*Attorney, Agent, or Firm*—Learman & McCulloch

[57] ABSTRACT

A spring chair has a seat frame and a base frame including an upper portion fixed to the seat frame, spaced front leg portions extending generally vertically down from said upper portions at the front of the seat portion, and base portions extending horizontally rearwardly from the leg portions to underlie the seat portion. The leg portions and base portions extend from a right angular bend portion and have lengthwisely extending openings. Unitary right angular springs inserted in the openings provide spring resilience to the bend portions which will restore them to normal position. The springs are preinserted in the linear extrusion strip which is bent to the base frame confuguration so that extrusion bending and spring bending occur simultaneously.

5 Claims, 2 Drawing Sheets

SPRING CHAIR FRAME AND METHOD OF FABRICATING SAME

BACKGROUND OF THE INVENTION

This invention relates to spring chair frames which may be formed from materials which are not springy in character, and yet which are light in weight and permit the economic fabrication of the chair. The present invention provides a novel structure which permits a spring chair frame to be formed of a light material such as an aluminum extrusion and to be economically formed according to a novel spring chair frame manufacturing method.

SUMMARY OF THE INVENTION

The present invention provides a spring chair frame comprising a base frame and a eat frame which secures to and is supported by the base frame. Either straps or cushions may be utilized on the sea frame to cushion the weight of the seat occupant in the usual manner. With the base frame formed of a material having a relatively low of elasticity, the right angular springs encased therein at the juncture of the vertical leg portions of the frame and the rearwardly extending base portions of the frame provide the resilience which returns the chair to original position through many years of use.

One of the prime objects of the present invention is to provide a spring chair frame having a base frame including front leg portions and rearwardly extending base portions which an be economically formed of a single lightweight aluminum extrusion strip with encased spring rods in predetermined position.

Another object of the invention is to provide a chair frame manufacturing method wherein a base frame of the character describe, formed of a single, continuous, linear length of extruded aluminum material is bent to shape with the springs preinserted so that the bending of both the rods and the extrusion can take place at the same time in the manufacturing process.

Other objects and advantages of the invention will be pointed out specifically, or will become apparent from the following description, when it is considered in conjunction with the appended claim and the accompanying drawings.

IN THE DRAWINGS

Figure 3:
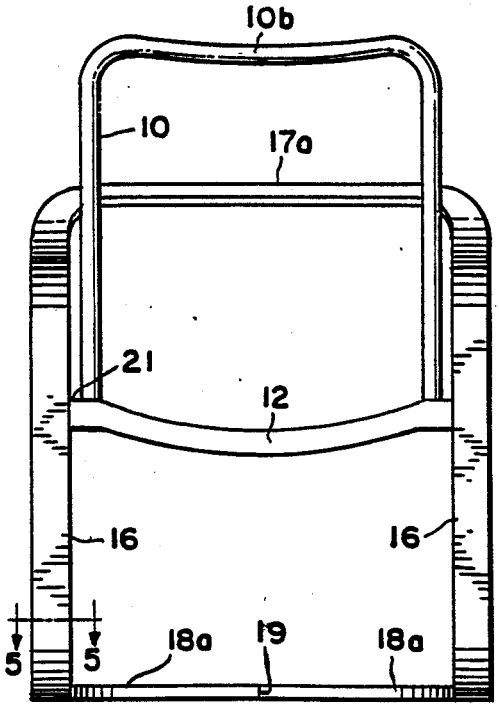
Figure 4:
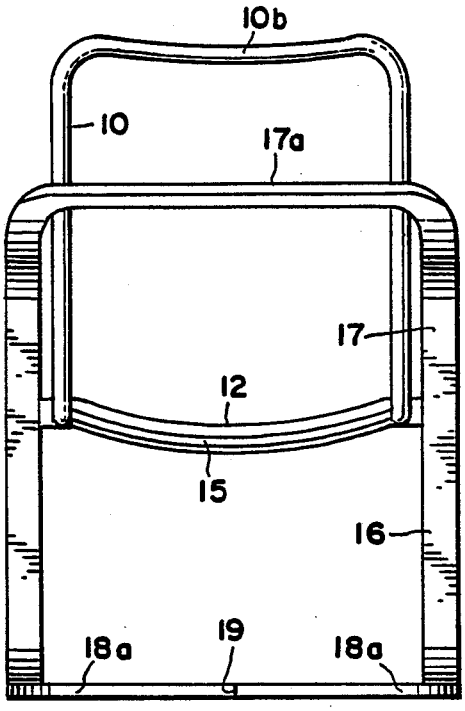
Figure 5:
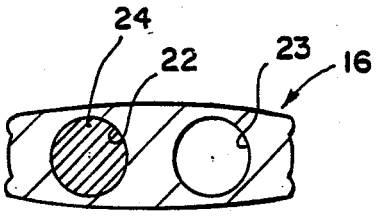
Figure 6:
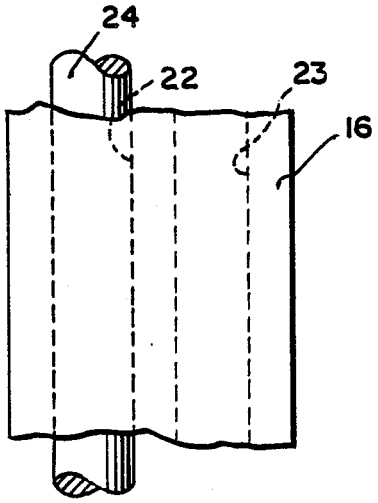

FIG. 3 front elevational view;

FIG. 4 is a rear elevational view;

FIG. 5 is an enlarged, cross sectional view taken on the line 5—5 of FIG. 3; and FIG. 6 is a fragmentary, enlarged front elevational view.

DETAILED DESCRIPTION

Figure 1:
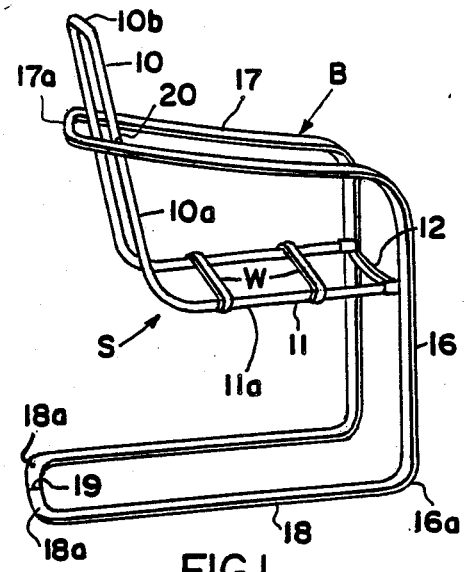
FIG. 1 is a perspective elevational view of a chair frame formed in with the invention.
Figure 2:
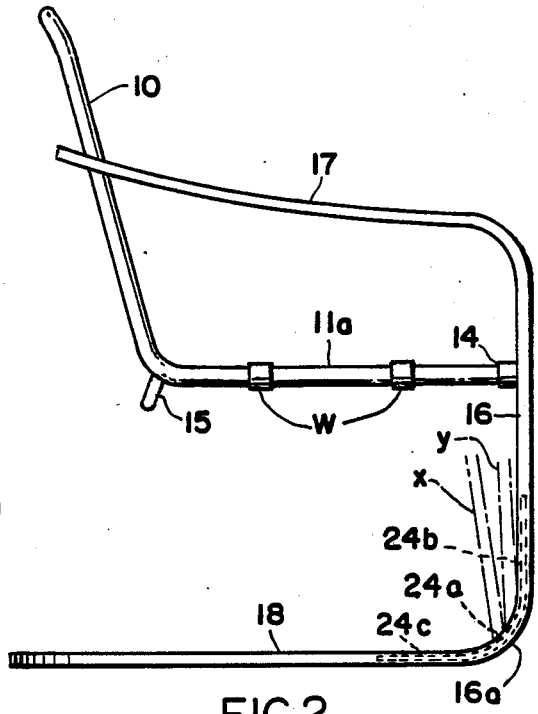
FIG. 2 is an enlarged, side elevational view thereof.

As FIG. 1 indicates, the chair frame is made up of a seat frame, generally designated S, and a base frame generally designated B. The seat frame S includes a back portion 10 and a seat portion 11 which may be formed of a single tubular aluminum rod and bent to the shape disclosed with generally horizontal portions 11*a*, and vertically inclined portions 10*a* joined by a spanning top rail 10*b*. At their front ends, the seat side rails 11*a* are joined by a front spanning member 12, having sockets 13 which receive the front ends of the tubular members 11*a* and are welded or otherwise suitably secured to the members 11*a* at 14. Plastic straps or webs W may join the members 10*a* and 11*a*. A brace member 15 may also be welded in position to span the seat frame, as shown in FIGS. 2 and 4.

The base frame B, which is made up of a single aluminum extrusion in a manner which will be described, includes generally vertical leg portions 16, horizontally inclined arm portions 17 connected by a rear spanning portion 17*a*, and rearwardly extending, floor or ground engaging base portions 18. The base portions 18 at their rear ends have inwardly turned parts 18*a* which are butt-welded as at 19 to provide a continuous base frame. The leg portions 18*a* are located rearwardly of the seat frame S to provide the desired stability. The arm portions 17 are welded or otherwise suitably fixed to the sides of the seat frame back members 10*a* at 20, and the seat frame front member 12 is welded or otherwise suitably fixed to the sides of the base leg portions 16 at 21.

The single aluminum extrusion strip, from which the base frame B is formed, has the cross-sectional configuration disclosed in FIG. 5 and is extruded with a pair of openings 22 and 23 which extend from one end of the strip to the other. Originally, the extrusion strip is linear in form and linear spring steel rods 24 are inserted into predetermined positions in the strip spaced a predetermined distance inwardly from the ends which later form parts 18*a*.

The rods 24, which are a slide flit in one of the openings 22 or 23, slide into position and may be retained in position by crimping the upper and lower walls of the extrusion 16 slightly adjacent the ends of the rods 24, or in any other acceptable manner. With the linear spring rods 24 in place in the outer opening 22, the composite extrusion strip may then be bent to the shape indicated in the drawing in a suitable bending machine or press, and the ends butt-welded at 19 in the manner indicated. At the time the bending press forms the portions 16 and 18 to right angular shape with a curvilinear connecting bend 16*a*, it will at the same time, form the rods 24 to right angular shape with a curvilinear connecting bend 24*a* which permanently retains the rods 24 in position. The rods 24 preferably may be about two feet long, with approximately twelve inches 24*b* extending in the leg portions 16 and twelve inches 24*c* in the base portions 18, as shown in FIG. 2. Each member 24 may be a 7/16 inch diameter spring steel rod having a high carbon and manganese content.

A chair frame formed in the manner indicated is sufficiently rugged and durable to be useful for many years.

THE OPERATION

In operation, when a person sits down in the seat portion S of the chair, the leg portions 16 and rod portions 24*b* will bend rearwardly to a position indicated at x initially, and then will resiliently move back to a less inclined load position y. Later when the seat occupant stands up and relieves the seat S of load, the portions 16 and 24*b* will return to the FIG. 2 solid line vertical position. It is the rod portions 24 in each leg which permit this return, since the aluminum extrusion portions 16 do not have the necessary resilience characteristics to permit this.

While one embodiment of the invention has been described in detail, it will be apparent to those skilled in the art that the disclosed embodiment may be modified.

Therefore, the foregoing description in all aspects is to be considered exemplary rather than limiting in any way, and the true scope of the invention is that defined in the following claims.

I claim:

1. A spring chain frame comprising:

a. a seat frame including a back portion and seat portion;

b. a continuous base frame formed of an extrudable, inelastic rigid non-steel material and including an upper portion and laterally spaced front leg portions extending generally vertically down from said upper portions at the front of said seat portion fixed to the seat frame and base portions extending horizontally rearwardly continuously from said front leg portions to underlie said seat portions;

c. said base frame front leg portions and base portions extending perpendicularly to one another and being formed from single extrusions each extending from and including a curvilinear bend portion integrally connecting them and each extrusion having communicating lengthwisely extending continuously enclosed openings therein with lengthwisely extending marginal walls; and d. unitary, generally right angular-shaped elastic spring steel rods having curvilinear bend portions with generally perpendicularly extending leg and base portions shaped to be disposed snugly in said openings in engagement with the walls thereof, and free ends of said steel rod leg portions extending partly in and terminating within said base frame front leg portions through said bend portions and free ends of said steel rod base portions extending partly in terminating within said base frame base portions to provide spring resilience for each bend portion which will restore the frame to normal position after it is deformed by the weight of a seat occupant and the load is relieved.

2. The chain frame of claim 1 wherein said base frame is an aluminum extrusion rod.

3. The chair frame of claim 1 wherein said base frame upper portion includes arm rest portions, extending rearwardly from the upper end of said leg portions, which have a connecting portion spanning said back portion of the seat frame rearwardly of the seat portion;

4. The chair frame of claim 3 wherein said base frame is formed of a single continuous member, bent to predesignated shape, said base portions each having inwardly bent abutting legs fixed together to form a base portion spanning member.

5. The chair frame of claim 1 wherein said base frame is formed of a material having a relatively low modulus of elasticity, and said spring steel rods are formed of material having a relatively high modulus of elasticity.

* * * * *

UNITED STATES PATENT AND TRADEMARK OFFICE

CERTIFICATE OF CORRECTION

PATENT NO. : 4,911,500

DATED : March 27, 1990

INVENTOR(S) : Herbert C. Saiger

It is certified that error appears in the above-identified patent and that said Letters Patent is hereby corrected as shown below:

In column 1, line 18, change "eat" to -- seat --;

In column 1, line 20, change "sea" to -- seat --;

In column 1, line 31, change "an" to -- can --;

In column 1, line 36, change "describe" to -- described --;

In column 1, line 49, after "in" insert -- accordance --;

In column 1, line 51, after "3" insert -- is a --;

In column 3, line 5, change "chain" to -- chair --;

In column 4, line 18, change the semi-colon to a period.

Signed and Sealed this

Twenty-fifth Day of June, 1991

*Attest:*

*Attesting Officer*

HARRY F. MANBECK, JR.

*Commissioner of Patents and Trademarks*